United States Patent [19]

Klug

[11] 4,107,485

[45] Aug. 15, 1978

[54] DEVICE FOR COMPLETING AN ELECTRIC CIRCUIT OR THE LIKE FOR A LOCK OR THE LIKE

[76] Inventor: Anton L. Klug, 144 Garfield Pl., East Rockaway, N.Y. 11518

[21] Appl. No.: 832,572

[22] Filed: Sep. 12, 1977

[51] Int. Cl.[2] ..... H01H 27/10

[52] U.S. Cl. ..... 200/43; 70/278

[58] Field of Search ..... 200/42 R, 43; 70/278, 70/313; 317/134; 340/274

[56] References Cited

U.S. PATENT DOCUMENTS

| | | | |
|---|---|---|---|
| 1,449,248 | 3/1923 | Rathlun | 200/42 R |
| 2,021,925 | 11/1935 | Schweiso | 200/43 X |
| 2,819,770 | 1/1958 | Gibbs | 180/82 |
| 3,518,383 | 6/1970 | Purpura | 200/43 |
| 3,722,238 | 3/1973 | Ring | 70/278 |
| 3,969,596 | 7/1976 | Siegel | 200/43 |

*Primary Examiner*—George T. Hall
*Attorney, Agent, or Firm*—Bauer, Amer & King

[57] ABSTRACT

As a requirement for the opening of a lock or similar security device, an operative group of partially series-interconnected switches is required to be completely series-interconnected, i.e. placed in a closed circuit relation. However, in contrast to a typical prior art electric lock, in which the few switches which operate the lock are grouped, in order to obviate unauthorized detection, with "decoy" switches, the within invention uses all switches in the lock-opening circuit, in that some switches are required to be actuated and the remainder not actuated, or otherwise the circuit cannot be completed. Thus, the security of the lock is significantly improved since unauthorized opening thereof requires not just determining the proper switches to actuate, but also the proper switches which should not be actuated.

6 Claims, 10 Drawing Figures

DEVICE FOR COMPLETING AN ELECTRIC CIRCUIT OR THE LIKE FOR A LOCK OR THE LIKE

The present invention relates generally to an improved control circuit for a lock or other security device, the improvements more particularly enabling the use of an optimum minimum number of switches in said lock-operating circuit because it is necessary in order to complete said circuit to determine the lock-operating mode of each switch, such that even the small number used statistically eliminates tampering as a plausible way of achieving unauthorized opening of the lock. The use of fewer switches contributes to reduced cost, less complexity and possibility of malfunction, and other such corresponding benefits.

It is already generally accepted, as exemplified by the electric lock of U.S. Pat. No. 1,449,248, that it is advantageous in proper circumstances to be able to operate a lock by completing an electric circuit associated therewith, rather than by manual manipulation of tumblers or a sliding bolt using a key, or by dialing a specified sequence and combination of numbers. In known electric locks, the typical control circuit for same includes a plurality of switches, of which only a few, presumably known only to authorized personnel, are required to be actuated preparatory to the opening of the lock. In effect, therefore, the just referred to few switches are the "operative" components of the control circuit, while the remaining switches are merely "decoys". It is undoubtedly to eliminate "trial and error" tampering as a plausible way of achieving unauthorized opening of the lock that presently available electric locks are characterized by an excessive number of switches. As an example, approximately 100 switches or switch-related structures are used in the electric lock of said U.S. Pat. No. 1,449,248, while in a preferred embodiment according to the present invention only 32 switches are used, and yet the permutations of switch combinations to operate the within 32-switch circuit is clearly too great to arrive at by tampering or similar unauthorized activity, being upwards of 4 billion permutations.

Broadly, it is an object to provide an improved control circuit for a lock or similar security device overcoming the foregoing and other shortcomings of the prior art. Specifically, it is an object to require a specific operating mode in each of a selected group of switches in said lock-operating circuit, so that completion of the circuit requires not just identification of the appropriate switches to actuate, but also identification of the appropriate switches not to actuate.

A device for completing an electric circuit for a lock or the like demonstrating objects and advantages of the present invention is electrically associated with first and second conductors of an electric circuit disposed in a normally open circuit relation to each other, and said device includes a cooperating plurality of electric switches operatively arranged so as to be effective in converting said open circuit relation of said conductors into a closed circuit relation upon the selective actuation of some of said switches and the non-actuation of the remainder thereof. Each said electric switch selected for use is of the type having a switch arm and at least two operative contacts, with one of which an electrical contact is established with said switch arm to the exclusion of the other. Operatively arranged upon being urged through movement to change said established electrical contact of each switch arm from one contact thereof to the other is a switch-actuating probe for each said switch. The switches are wired in a partial series interconnection by wiring or conductors connected between some of the switch contacts with which the switch arms have a normally established electrical contact, and also wiring connected with some of said other contacts. Cooperating with the switches or, more particularly, with the probes thereof is a probe-actuating member having bores therein in locations aligned with the probes of said switches having said established contact with said switch arms thereof and in remaining locations having probe-contacting surfaces for making pushing contact against said other probes. Thus, upon closing movement of said probe-activating member against said probes, this movement does not disturb the established electrical contact of those of said switches in said locations of said bores therein, and in said other locations the movement newly creates an established electrical contact, to the end of completing the series interconnection of all of the switches. When the switches are in series, this correspondingly establishes a closed circuit relation between said first and second circuit conductors and thus results in the opening of the lock or the like.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIGS. 1, 2 and 3 are illustrative of the environment in which the inventive device hereof may be used; said drawing figures also illustrate a typical prior art device having the same objective, but which achieves said objective with entirely different structure operating in an entirely different way. More particularly, FIG. 1 is a front elevational view, partly broken away, of a known so-called electric lock in its installed condition on a door;

FIG. 2 is an enlarged front view, again partly broken away, showing details of the prior art electric lock; and FIG. 3 is a diagrammatic view of the circuits employed in the prior art electric lock.

The remaining figures illustrate the improved inventive device hereof which also can be used as an electric lock but is not necessarily limited to this end use. More particularly, FIGS. 4A and 4B are plan views respectively illustrating the two components which comprise the inventive device hereof. Specifically, FIG. 4A, like FIG. 2, is a front elevational view of the component which contains the operative arrangement of the electrical switches, whereas FIG. 4B is similarly a front elevational view, but is the component which is movable in covering relation over the component of FIG. 4A incident to actuating some and not actuating others of said electrical switches;

Figure 4A:
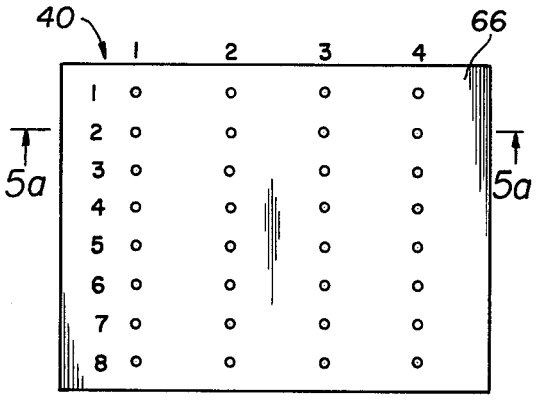
Figure 4B:
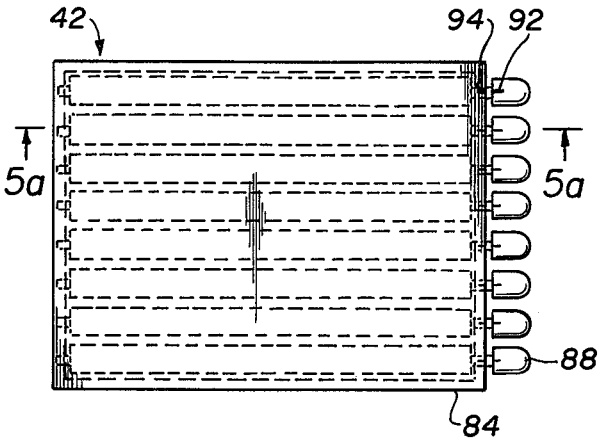
Figure 7A:
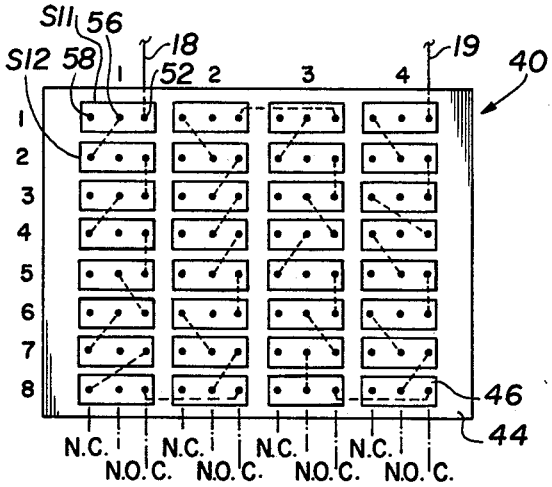
Figure 7B:
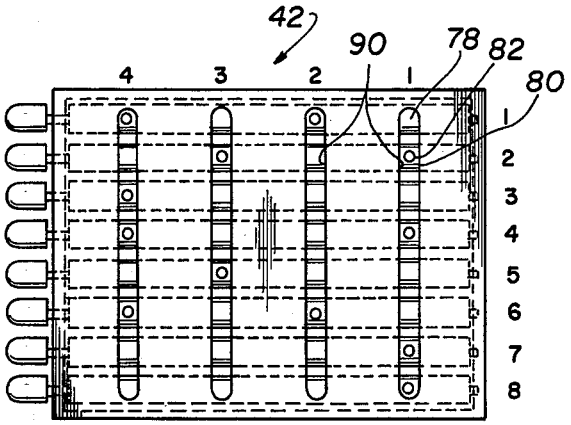

FIG. 7A is a diagrammatic view illustrating the typical manner in which the electrical switches are electrically interconnected with each other to provide a partially completed series connection which, according to the present invention, is completed upon the actuation of some switches and the non-actuation of others; and FIG. 7B diagrammatically illustrates the manner in which it is arranged, when using the component of FIG. 4B, that some of the switches be actuated and others not actuated.

PRIOR ART ELECTRIC LOCK

It is already well known, as exemplified by U.S. Pat. No. 1,449,248, that an electric lock for a door or the like can be obtained by use of an appropriate operative arrangement of electrical components that initially are in an open circuit relation to each other and then have this relation changed to that of a closed circuit, which then permits the opening of a lock or other type of security device. Since the operation of the lock is related to the completing of an electrical circuit, the use of a key or other typical means of mechanically opening or closing the lock can be dispensed with, and it is felt by many to be more advantageous from a security point of view since it minimizes the unauthorized opening of the lock by anyone who can gain possession of the key for that lock. On the other hand, the advantage of using the just referred to so-called electric lock is all but lost if it is possible for an unauthorized person to complete the electrical circuit, which is the basis of operation thereof, because statistically or for any other reason, it is not that burdensome for an individual to randomly operate the switches of the electric lock in order to cause its unauthorized opening.

Prior to the improved device hereof, known electric locks were vulnerable to tampering which resulted in their unauthorized operation. Generally this is due to the fact that although a plurality or number of electrical switches were used in the lock, not all of these switches were directly involved in the operation thereof. Rather, in the usual case, only one or two of the multiple switches were required to be closed in order to complete the circuit, while the other switches were merely "decoys" and had no significant operational effect. Thus, by merely trial and error it was not too burdensome, unless an extremely large number of "decoy" switches were involved, for an individual to achieve unauthorized opening of a prior art electric lock. The use of a signigicant number of "decoy" electric switches in order to render it statistically more difficult to operate the electric lock is not an entirely satisfactory solution since it contributes to an excessive cost of the electric lock and other disadvantages.

Additionally, the typical prior art electric lock which uses only a small number of "operative" electric switches and a significantly greater number of "decoy" switches, as just generally described, has still another shortcoming. Specifically, in such prior art electric locks it is necessary to obviate the operation thereof by anyone who causes the electrical completion of all the switches since this, of necessity, includes the completion of the few "operational" switches that will in turn correspondingly operate the electric lock. Thus, it is necessary to arrange that when one or more of the "decoy" switches are also completed, that this renders it impossible for the lock to be opened. The inclusion of this lock-disabling circuit also contributes to an unnecessary excessive cost of typical prior art electric locks.

As will be explained in detail subsequently, the improved device hereof, as described and more particularly illustrated in FIGS. 4A–7B, inclusive, effectively overcomes the foregoing and other shortcomings of typical prior art electric locks. Before proceeding with a detailed description thereof, however, it is useful to describe the environment in which it is contemplated using the device, as well as describing a typical prior art electric lock for purposes of comparison. To this end, reference is first made to FIGS. 1–3 in which 1 designates an ordinary sliding bolt arranged to be operated in the usual manner by a knob 2, of a lock 3, which is mounted on a door 4. The knob 2 is arranged to withdraw in the usual manner the bolt 1 from a strike plate 5 fastened to the frame 6 of the door.

7 designates a locking member having one end supported by a flat spring 8, which has one end secured in a suitable post 9. The other end of the locking member 7 is provided with a projection 10, which is adapted to enter a notch 11 in the bolt 1 for holding the bolt in the locked position, and in a manner such that the bolt 1 cannot be retracted by turning the knob 2 unless the locking member 7 has been withdrawn from the notch 11.

The bolt 1 is also provided with a notch 12, which is adapted to receive the projection 10 for holding the bolt in the unlocked position.

Mounted on and secured to the outer side of the door 4, preferably adjacent to the lock 3, is a vertical plate 13 of insulating material which is provided with a plurality of transverse holes preferably arranged in regular order in horizontal and vertical rows, and in which are respectively secured contacts comprising similar pins 14, some of which are inactive and disconnected with any circuit (i.e. "decoys"), and others of which are active; that is, included in an electric circuit or circuits.

In front of the contact support 13 and secured to and spaced apart therefrom is a guard member 15, which covers the contacts mounted in the support 13 and which is provided with transverse holes 16, which respectively align with the contact pins and which are adapted to receive the ends of a conductor, which may be termed the key conductor 17.

Figure 3:
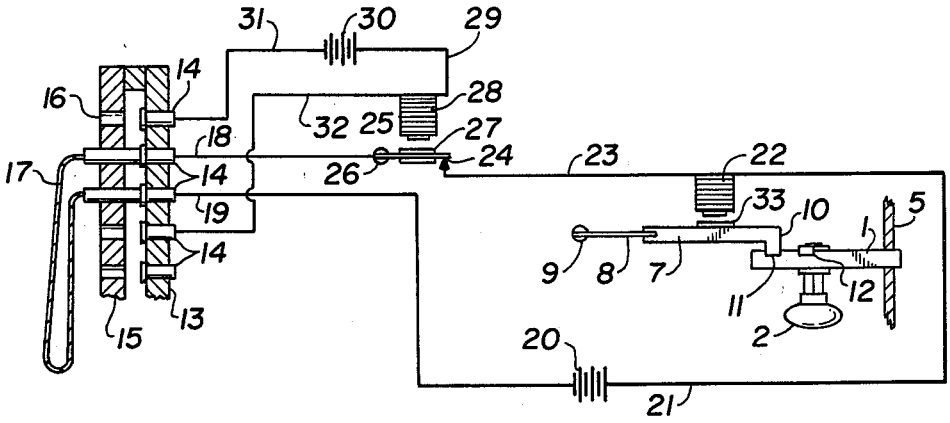
FIG. 3 PRIOR ART

Shown in FIG. 3 is an electric release circuit which includes two contacts 14 to which are respectively connected conductors 18 and 19. Conductor 19 is connected to one pole of battery 20, the other pole of which is connected by a conductor 21 to one terminal of a magnet 22, the other terminal of which magnet is connected to a conductor 23, which is connected to a contact 24, against which normally bears a spring 25, which has its free end mounted in a post 26, to which the conductor 18 is connected.

The spring 25 carries an armature 27 located in the magnetic field of an electro magnet 28, one terminal of which is connected to a conductor 29 which is connected to one pole of a battery 30, the other pole of which is connected by a conductor 51 with another of the contacts 14. The other terminal of the magnet 28 is connected to still another one of the contacts 14.

The contact 24, spring 25, post 26 and armature 27 form a circuit closer which is normally in the closed position shown in FIG. 3.

In the normal operation of this lock in the form shown in FIG. 3, the spring 8 normally forces the locking member into position for entering either the notch 11 or the notch 12. When it is desired to unlock the bolt 1, the authorized person, knowing the combination and having in his possession the key conductor 17, inserts the end of the latter through the proper holes in the guard 15 and respectively against the two contacts in the rear thereof, which are respectively connected to the conductors 18 and 19. The current will then pass from the battery 20 through the conductor 21, conductor 23, contact 24, spring 25, post 26, conductor 18, thence through the adjacent contact 14 and key conductor 17, to the contact to which is connected the conductor 19, thence back to the battery 20.

The magnet 22 being energized by the current passing through the circuit attracts an armature 33, which is in the field of the magnet, and which is attached to the locking member 7. The latter will thus be moved to the released position out of the notch 11, after which the operator may turn the knob 2 to withdraw the bolt 1 out of the strike plate 5, upon which the door may be opened.

In case that someone tries to feloniously operate the mechanism, and attempts to do this by inserting wires in all the holes 16 and against the contacts 14 and then connects such wires together, the contacts 14 which are connected to the conductors 31 and 32 will have the circuit which includes the magnet 28 closed through them by the inserted wires, upon which the magnet 28 will be energized and will draw toward it the armature 27 and with it the spring 25, thus separating the latter from the stationary contact 24, thereby opening the circuit which includes the magnet 22, so that the latter cannot be energized and made to release the bolt 1 from the locking member 7.

Figure 1:
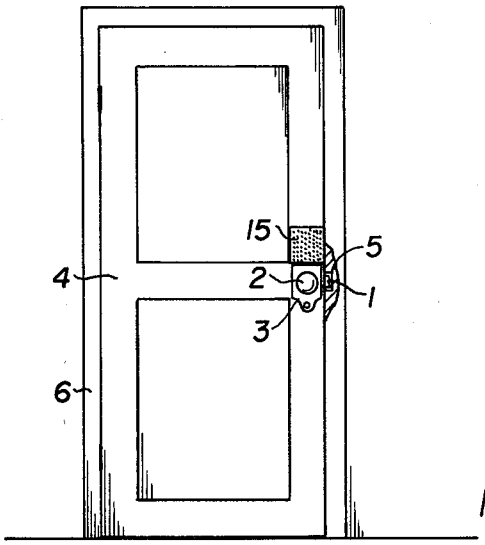
FIG. 1 PRIOR ART
Figure 2:
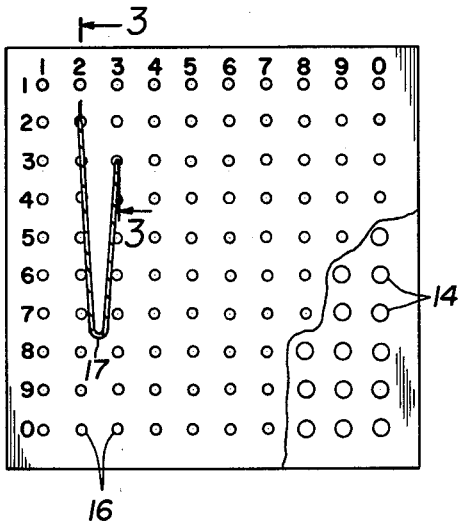
FIG. 2 PRIOR ART

While the electric lock 1 as just described is useful for the purposes intended, it should be obvious from the description thereof that except for the actual switches and contacts 14 that are associated with the conductors 18 and 19 that the remaining or so-called "decoy" contacts 14 or switches do not play a significant or meaningful part in the operation of the electric lock and to this extent therefore the prior art lock of FIGS. 1–3 has limited usefulness as a security device. Also, to a lesser extent, the fact that it can be readily observed in which opening the key conductor 17 is inserted in order to operate the lock also contributes to the unauthorized opening of the lock. These and other shortcomings of known electric locks, as exemplified by the lock of FIGS. 1–3, are obviated by the construction and mode of operation of the improved device hereof now to be described in connection with FIGS. 4A–7B. Although the device is not necessarily limited to being used as part of an electric lock this is a primary contemplated end use and will therefore be described and illustrated in connection with this end use.

IMPROVED DEVICE FOR COMPLETING AN ELECTRIC CIRCUIT FOR A LOCK OR THE LIKE

As shown in FIGS. 4A, 4B, the improved device hereof consists essentially of two components. One component, designated 40 in FIG. 4A, is the component having the electric switches embodied therein and is thus the counterpart of what was previously described in connection with FIG. 2. The other component, designated 42 in FIG. 4B, is the counterpart of the previously described key conductor 17. Key 42 hereof, however, is adapted in use to be placed in covering relation over the face of the switches embodied in the component 40 incident to activating some of the switches and non-activating others, all as will be subsequently explained. It is convenient at this point to note that the covering relation of component 42 over the face of 40, as more particularly illustrated in FIG. 5A, renders it practically impossible for an unauthorized observer to determine which specific switches are being actuated in the operation of the within device.

The switch-supporting component 40 is comprised of a switch-retaining bracket 44 and a rectangular panel 68 which has appropriate counterbores 72 therein in facing relation to eight rows of four electrical switches, individually and collectively generally designated 46, making a total of 32 switches. These eight rows of four switches each are illustrated in the plan view of FIG. 4A and also in the wiring diagram of FIG. 7A.

Figure 5A:
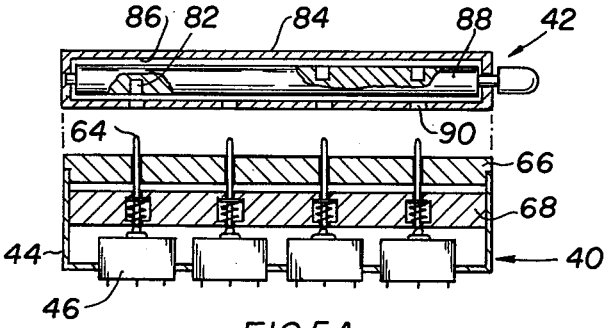
FIG. 5A is a side elevational view, in section taken along lines 5A—5A of FIGS. 4A and 4B, showing further structural details.
Figure 5B:
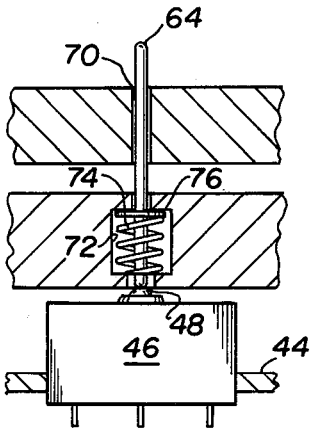
FIG. 5B is a partial side elevational view, on an enlarged scale, which best illustrates the preferred manner of operatively arranging a probe in a switch-actuating relation to a cooperating switch.
Figure 6:
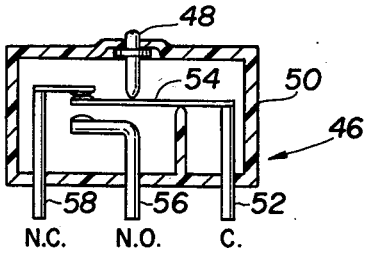
FIG. 6 is a simplified side elevational view of a typical electrical switch proposed for use in the inventive device hereof, the simplified showing thereof being utilized since such switches are readily commercially available and therefore their construction and mode of operation are already well understood.

As illustrated in FIG. 5A, the mounting of the switches 46 is typically behind a wall or other security barrier 66 and is such as to project a first probe 48 for the switch arm of each switch in an operative position forward of the front face of the switch. Probe 48 is thus in an advantageous position to be contacted even though behind the barrier 66 incident to modifying the normally established electrical contact that is characteristic of the switch 46. To better understand what has just been referred to, reference should be made to FIG. 6 which illustrates in simplified form the essential structural features of the switch 46. More particularly, each switch 46 is of the type that is readily commercially available which includes appropriately contained within a plastic box-like structure 50 three contacts extending therefrom. One contact, designated 52 and also "C" is the permanent contact for the movable contact switch arm 54; the other contact 56 also designated "NO" is the normally open contact in the sense that the switch arm 54 is normally in a clearance or open circuit relation thereto as illustrated in FIG. 6; and the remaining contact 58, also designated "NC", is the contact that normally has electrical contact established between it and the switch arm 54, as at 60. Thus, prior to operation of switch 46, which operation contemplates the depressing of the probe 48 against the switch arm 54, the electrical circuit is normally completed between contacts 52 and 58. However, upon the depressing of the probe 48, switch arm 54 moves out of its established contact with contact 58 and into contact with contact 56, thereby changing the established electrical contact of switch contact 52 from contact 58 to contact 56. Upon the release of probe 48, switch arm 54 returns by virtue of its own inherent resiliency back to its established contact, as at 60, with contact 58, being aided in this return movement by the movement-biasing post 62. The significance of changes between the contacts 56 and 58 with which contact 52 cooperates in the completing of an electric circuit will become more obvious as the description proceeds.

To facilitate actuating each switch 46 it is preferred that the probe 48 be in turn contacted by a second more accessible probe, individually and collectively designated 64. That is, each switch 46 has a cooperating probe 64 and said probe is appropriately arranged for sliding movement so as to push against and actuate the switch probe 48. As is perhaps best illustrated in FIG. 5B, probe 64 is slidably disposed in a bore 70 which extends through the structures 68 and 66 in front of the switches 46. As illustrated, each bore 70 terminates in a previously noted counterbore which forms a compartment 72 in which a larger diameter portion 76 on probe 64 functions both as a stop for sliding movement of the probe and also as a seat for one end of a return spring 74. As can be readily appreciated from FIGS. 4A, 5A and 5B, the ends of the 32 probes 64 for each of the switches 46 are arranged in eight rows of four each in the specific positions illustrated, and are readily accessible to be contacted by movement of the key panel 42 in covering relation against the front face of the barrier panel 66. As will be subsequently explained, this movement of the key panel 42 against the panel 66 causes some of the probes 64 to be depressed while others are not disturbed, all to the end of actuating some of the switches 64 and intentionally not actuating others. In this connection, and as perhaps may be best appreciated from FIG. 7A, the switch-containing component is electrically connected across the conductors 18 and 19 of the lock which is operated when the circuit is complete across the conductors 18 and 19, all as has been described in connection with the electric lock of FIGS. 1–3. A significant difference, however, is that component 40 is only partially interconnected in series so that the circuit is not completed until the series interconnection of the switches 46 is in turn completed. In accordance with the present invention this can only be achieved when select numbers of the switches 46 are actuated and, of equal importance, when the remaining switches 46 are not actuated. In this way, all of the switches 46 play a significant part in achieving a closed circuit relation of the switch-containing component 40 with respect to the conductors 18 and 19.

For a complete understanding of the manner in which this is achieved reference should be had to the wiring diagram of FIG. 7A in which particular note should be made of the switch specifically designated S11 which occupies position 1 of row 1 and the switch specifically designated S21 which occupies position 2 of row 1. More particularly, it will be noted that contact 18 is connected to the common contact 52 of switch S11 and that the normally open contact 56 thereof is connected to the normally closed contact 58 of switch S21. Completing the wiring for switch S21 is a conductor, represented by the dash line, connected from its common contact 52 to the common contact 52 of the next encountered switch. From what has already been described in connection with the switches S11 and S21, it should be readily appreciated that with respect to conductor 18 switch S11 represents an open switch or an electrical discontinuity in that the conductor which leads from this switch is from the normally open contact 56 thereof. Thus it is necessary that the switch arm of switch S11 be moved from its established contact with the normally closed contact 58 to the normally open contact 56 in order for there to be a current flow through conductor 18 and through the switch S11 to the next encountered switch S21. To implement this, and as perhaps is best illustrated in FIG. 7B, key member 42, and more particularly surface portion 78 thereof, which will be understood to be that portion which aligns with the switch S11, presents a flat surface which is adapted to contact and therefore depress the cooperating probe 64 which, in turn, will operate the switch S11 so that the contact arm 54 thereof changes its established contact from contact 58 to contact 56.

FIG. 7B also illustrates that at the location of key member or panel 42 which coincides with switch S21 and which is designated by the reference numeral 80, that there is a space or bore 82 which will be understood to align with probe 64 which extends from the panel 66. As a consequence, during movement of the key panel 42 against the panel 66, said probe 64 will project itself within the bore opening 82 and thus this probe will not be depressed, and thus the switch associated with this probe will not be operated to the extent that the switch arm 54 thereof is disturbed from its normal position establishing contact between the common contact 52 and normally closed contact 58. Thus, there will be no change in switch S21 and thus as a result of the connection being made to its normally closed contact 58, a circuit can be traced from contact 58 through switch arm 54 to common contact 58 of this switch, and from this contact to the common contact 52 of the next encountered switch. In this manner, namely by the appropriate actuating of select switches 46 as well as the non-actuating of the remaining switches 46, the initial partially complete series interconnection of the 32 switches 46 is changed to one of a complete or closed circuit relation, and this correspondingly completes the circuit between the conductors 18 and 19 which is required in order to operate the lock or similar such device.

The manner in which the switches are wired in relation to each other to achieve the objectives of the present invention is readily understood from the wiring diagram of FIG. 7A and therefore a description thereof has been omitted as being unnecessary. For completeness sake, however, it is noted that in a preferred embodiment, and as is illustrated in FIG. 7B, that typically as many as 12 of the switches 46 will be wired so that their non-operation is required in conjunction with the operation of the remaining switches in order to complete the circuit of the series interconnected switches. The position of these 12 switches corresponds to the illustrated positions of the bores individually and collectively designated 82.

A preferred construction for the key member 42 is illustrated in FIGS. 4B and 5A. As illustrated therein, member 42 includes a rectangular housing 84 which bounds a compartment 86. Appropriately rotatably mounted in compartment 86 are eight rods 88, each controlling four switches 46, and each having 32 bores 82 machined therein. The locations for the bores 82 are selected to expose all possible permutations of the bores 82 in 16 rotative positions of each rod 88, the significance of which will soon be apparent.

One wall of housing 84 has 32 openings 90 therein which are appropriately located to align with the 32 switch probes 64. As illustrated in FIG. 5A, the arrangement of the openings 90 is in eight rows of four each in which each row is oriented along the longitudinal axis of each rod. Thus, by appropriately rotating each rod 88, perhaps so that a reference marking 92 thereof aligns with a cooperating reference marking 94 on the housing member 84 of member 42, it can be arranged that a select number and location of bores 82 in each rod are brought into alignment with the openings 90. When member 42 is closed against panel 66 all of the probes 64 of course project through openings 90, some of the probes further projecting themselves in the bores 82 and thereby not causing any change in the switches corresponding therewith, while the remaining probes 64 contact the surface of each rod 88 and are depressed as a result of this contact and thus cause a change in the established electrical contact of the switch, all as already explained. Thus, the devices 40, 42 hereof are effective in completing an electrical circuit incident to the operation of a lock or the like and, more important, in achieving this objective by utilizing in a significant manner all of the electrical switches 46 which are part of the construction thereof. This, of course, is in contrast to prior art electric locks or the like in which the electrical switches to a significant extent are merely used as decoys and thus do not play a significant or meaningful part in comprising the universe of permutations of possible combinations of switches which must have the proper electrical contact established in order to provide a closed circuit relation in the component 40.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A device for completing a circuit for operating a lock or the like, said device comprising first and second conductors of said circuit disposed in a normally open circuit relation to each other, a cooperating plurality of switch means operatively arranged so as to be effective in converting said open circuit relation of said conductors into a closed circuit relation upon the selective actuation of some of said switch means and the non-actuation of the remainder thereof, each said switch means being of the type having at least a conductive and a non-conductive operating mode of which one such mode always is operational to the exclusion of the other, conductors for connecting said switch means in said conductive modes to said non-conductive modes of other of said switch means so as to form a partial series interconnection of said switch means, and a switch means-actuating member operatively effective to modify the non-conductive modes of select numbers of said switch means and not to disturb the conductive modes of the remainder thereof upon movement thereof into a position adjacent said switch means so as to cause the aforesaid modification therein, whereby said switch means-actuating member in said position adjacent to said switch means is effective in establishing a closed circuit relation between said first and second circuit conductors.

2. A device for completing an electric circuit for a lock or the like, said device comprising first and second conductors of an electric circuit disposed in a normally open circuit relation to each other, a cooperating plurality of electric switches operatively arranged so as to be effective in converting said open circuit relation of said conductors into a closed circuit relation upon the selective actuation of some of said switches and the non-actuation of the remainder thereof, each said electric switch being of the type having a switch arm and at least two operative contacts with one of which an electrical contact is established with said switch arm to the exclusion of the other, a switch-actuating probe for each said switch operatively arranged upon being urged through movement to change said established electrical contact of such switch arm from one contact thereof to the other, conductors for electrically connecting said switches in a partial series interconnection by being disposed in spanning relation between some of said contacts thereof with which said switch arms have an established electrical contact and also with some of said other contacts, and a probe-actuating member having bores therein in locations aligned with said probes of said switches having said established contact with said switch arms thereof and in remaining locations having probe-contacting surfaces for making pushing contact against said other probes, whereby closing movement of said probe-actuating member against said probes does not disturb the established electrical contact of those of said switches in said locations of said bores therein and in said other locations provides an established electrical contact in a completed series interconnection therewith, to thereby correspondingly establish a closed circuit relation between said first and second circuit conductors.

3. A device for completing an electric circuit as defined in claim 2 wherein said probe-actuating member is comprised of rotatably mounted rods, and each said rod is adapted to have said bores therein in specified locations therealong, whereby said bores are readily placed in aligning relation to said probes by appropriate rotation of each said rod.

4. A device for completing an electric circuit as defined in claim 3 wherein said probe-actuating member has a housing enclosing said rods, said housing being of a size and shape corresponding to that of said operative arrangement of said probes of said electric switches, whereby said probe-actuating member is adapted to be visually aligned by said similar sizes and shapes during said movement in covering relation over said probes.

5. A device for completing an electric circuit as defined in claim 4 wherein plural electric switches are used, said switches being arranged in multiple rows of at least four switches each.

6. A device for completing an electric circuit as defined in claim 5 wherein at least 32 electric switches are used, said switches being arranged in eight rows of four each.

* * * * *